US011304277B2

(12) United States Patent
Antony et al.

(10) Patent No.: US 11,304,277 B2
(45) Date of Patent: Apr. 12, 2022

(54) TUNEABLE LIGHTING SYSTEMS AND METHODS

(71) Applicants: OSRAM SYLVANIA Inc., Wilmington, MA (US); OSRAM GmbH, Munich (DE)

(72) Inventors: Biju Antony, Lynnfield, MA (US); Markus Ziegler, Munich (DE); Driss Baba, Swampscott, MA (US); Daniel Chu, Andover, MA (US)

(73) Assignee: ARL IP HOLDING LLC, Atlanta, GA (US)

( * ) Notice: Subject to any disclaimer, the term of this patent is extended or adjusted under 35 U.S.C. 154(b) by 642 days.

(21) Appl. No.: 16/096,695

(22) PCT Filed: Apr. 25, 2017

(86) PCT No.: PCT/US2017/029409
§ 371 (c)(1),
(2) Date: Oct. 25, 2018

(87) PCT Pub. No.: WO2017/189571
PCT Pub. Date: Nov. 2, 2017

(65) Prior Publication Data

US 2021/0227661 A1 Jul. 22, 2021

Related U.S. Application Data

(60) Provisional application No. 62/327,281, filed on Apr. 25, 2016.

(51) Int. Cl.
*H05B 45/20* (2020.01)
*H05B 47/19* (2020.01)
(Continued)

(52) U.S. Cl.
CPC ..... *H05B 45/20* (2020.01); *H05B 45/10* (2020.01); *H05B 45/345* (2020.01); *H05B 47/19* (2020.01); *H05B 45/395* (2020.01)

(58) Field of Classification Search
CPC ..... F21Y 2115/10; F21Y 2113/13; F21Y 2113/00; F21Y 2105/18; F21Y 2103/10;
(Continued)

(56) References Cited

U.S. PATENT DOCUMENTS 6,127,783 A 10/2000 Pashley et al.
2006/0273331 A1 12/2006 Lim et al.
(Continued)

FOREIGN PATENT DOCUMENTS

EP 2 704 534 A1 3/2014
WO 2014013462 A2 1/2014

OTHER PUBLICATIONS

Andrew Erskine, International Search Report and Written Opinion of the International Searching Authority for PCT/US2017/029409, dated Apr. 25, 2017, pp. 1-15, European Patent Office, Rijswijk, The Netherlands.

*Primary Examiner* — Monica C King
(74) *Attorney, Agent, or Firm* — Kilpatrick Townsend & Stockton LLP

(57) ABSTRACT

Color tunable lighting systems and methods are disclosed. The color tunable lighting systems and methods include user interfaces that allow for the control of color temperature and luminous intensity by a user. The systems and methods provide for flexibility and scalability, where a control module for controlling one or more solid state light source arrays can be programmed during installation for use with specific solid state light source arrays.

19 Claims, 6 Drawing Sheets

(51) Int. Cl.
*H05B 45/345* (2020.01)
*H05B 45/10* (2020.01)
*H05B 45/395* (2020.01)

(58) Field of Classification Search
CPC ..... F21Y 2105/10; F21Y 2107/30; F21Y 2113/10; F21Y 2101/00; F21Y 2105/00; F21Y 2105/16; F21Y 2107/90; F21Y 2115/15; F21Y 2103/33; F21Y 2103/00; F21Y 2105/12; F21Y 2107/10; F21Y 2107/20; F21Y 2107/70; F21Y 2115/30; H05B 45/20; H05B 47/19; H05B 47/11; H05B 47/105; H05B 47/18; H05B 47/16; H05B 47/175; H05B 47/185; H05B 45/10; H05B 45/12; H05B 45/30; H05B 45/325; H05B 45/46; H05B 45/37; H05B 47/10; H05B 31/50; H05B 45/395; H05B 45/00; H05B 45/28; H05B 47/12; H05B 45/345; H05B 45/3578; H05B 45/3725; H05B 45/385; H05B 45/50; H05B 45/60; H05B 47/115; H05B 47/13; H05B 47/165; H05B 47/195; H05B 45/18; H05B 45/22; H05B 45/315; H05B 45/36; H05B 45/375; H05B 47/155; H05B 3/008; H05B 45/31; H05B 45/38; H05B 45/40; H05B 45/44; H05B 45/24; H05B 45/34; H05B 45/355; H05B 45/397; H05B 45/56; H05B 47/125; H05B 47/24; H05B 47/25; H05B 47/26; F21V 29/74; F21V 23/06; F21V 7/00; F21V 21/005; F21V 29/70; F21V 3/00; F21V 3/02; F21V 23/02; F21V 29/507; F21V 15/015; F21V 17/12; F21V 19/008; F21V 23/005; F21V 23/009; F21V 23/04; F21V 23/003; F21V 21/088; F21V 23/0471; F21V 15/01; F21V 19/0015; F21V 23/001; F21V 5/04; F21V 9/08; F21V 19/006; F21V 19/02; F21V 23/002; F21V 23/006; F21V 14/006; F21V 21/02; F21V 21/03; F21V 21/30; F21V 23/0464; F21V 23/0478; F21V 29/773; F21V 29/89; F21V 5/002; F21V 5/045; F21V 9/02; F21V 13/02; F21V 14/02; F21V 14/04; F21V 17/10; F21V 17/101; F21V 23/0442; F21V 29/763; F21V 7/0016; F21V 7/0091; F21V 9/20; F21V 9/30; F21V 9/45

See application file for complete search history.

(56) References Cited

U.S. PATENT DOCUMENTS

| | | | | |
|---|---|---|---|---|
| 2008/0252197 | A1 | 10/2008 | Li et al. | |
| 2011/0115407 | A1 | 5/2011 | Wibben et al. | |
| 2012/0119658 | A1 | 5/2012 | McDaniel | |
| 2015/0351169 | A1* | 12/2015 | Pope ..... | H05B 45/20 315/193 |
| 2017/0127485 | A1* | 5/2017 | Hsia ..... | H05B 45/60 |

* cited by examiner

TUNEABLE LIGHTING SYSTEMS AND METHODS

CROSS-REFERENCE TO RELATED APPLICATION

The present application is National Stage application of, and claims priority, and the benefit of, International Application No. PCT/US2017/029409, filed Apr. 25, 2017, entitled "TUNABLE LIGHTING SYSTEMS AND METHODS" which claims priority, and the benefit of U.S. Provisional Patent Application No. 62/327,281, filed Apr. 25, 2016, the entire contents of which are hereby incorporated by reference.

TECHNICAL FIELD

The present invention relates to lighting, and more specifically, to lighting systems that are tunable.

BACKGROUND

A number of systems and methods have been developed for controlling the color temperature and luminous intensity of light emitted by solid state light source-based lighting systems. There are a variety of benefits provided by such control, such as supporting human circadian rhythm, correcting circadian rhythm misalignment, simulating natural daylight indoors, assisting behavior control such as in classrooms, mood setting, matching room finishes when a space undergoes a theme change, etc.

SUMMARY

In an embodiment, there is provided a lighting system. The lighting system includes: a plurality of solid state light source arrays configured to emit correlated color temperature (CCT)-tunable light, each of the plurality of solid state light source arrays including a plurality of solid state light source modules; a user interface configured to provide a CCT signal for setting a CCT of the light emitted by the plurality of solid state light source arrays; and a control module operably connected to the plurality of solid state light source arrays and the user interface, the control module configured to receive the CCT signal and to provide a constant current to each of the plurality of solid state light source arrays to cause the plurality of solid state light source arrays to emit light with a CCT according to the CCT signal.

In a related embodiment, the lighting system may further include a programming interface to program the control module with solid state light source module parameters during installation of the lighting system. In another related embodiment, the user interface may be configured to provide a dimmer signal to set a luminous intensity of light emitted by the plurality of solid state light source arrays, wherein the control module may be configured to receive the dimmer signal and to provide the constant current to the plurality of solid state light source arrays to cause the plurality of solid state light source arrays to emit light with a CCT and luminous intensity according to the CCT signal and the dimmer signal.

In still another related embodiment, each of the plurality of solid state light source arrays may further include a housing, the plurality of solid state light source arrays being located in a spaced relationship within an interior space of a structure, the control module configured to provide the constant current to each of the plurality of solid state light source arrays to drive the solid state light source arrays.

In yet another related embodiment, the plurality of solid state light source modules may include a first solid state light source module configured to emit a white light with a first substantially constant CCT and a second solid state light source module configured to emit a white light with a second substantially constant CCT, wherein the second substantially constant CCT may be different than the first substantially constant CCT.

In a further related embodiment, the lighting system may be configured to emit a CCT-tunable white light over a CCT range, wherein the CCT range extends between the first substantially constant CCT and the second substantially constant CCT. In a further related embodiment, the control module may be configured to control the CCT of light emitted by the plurality of solid state light source arrays over a substantially linear control curve in a chromaticity color space. In another further related embodiment, the control module may be configured to control the CCT of light emitted by the plurality of solid state light source arrays over a substantially linear control curve that approximates a color temperature emitted by a black body radiator.

In another further related embodiment, the control module may include a first linear regulator to provide a constant current to the first solid state light source module and a second linear regulator to provide a constant current to the second solid state light source module. In a further related embodiment, the control module may include a microcontroller configured to apply the CCT signal to a color control algorithm and to determine first and second control signals to control the first linear regulator and the second linear regulator.

In another embodiment, there is provided a control module. The control module includes: a microcontroller configured to: receive a correlated color temperature (CCT) signal and a dimmer signal; and execute a color control algorithm to determine a first linear regulator control signal and a second linear regulator control signal, wherein the first linear regulator control signal and the second linear regulator control signal are each based on the CCT signal and the dimmer signal; and first and second linear regulators configured to generate corresponding respective first and second solid state light source drive currents according to the first and second linear regulator control signals.

In a related embodiment, the microcontroller may be field programmable to receive solid state light source parameters, and the microcontroller may be configured to apply the solid state light source parameters to the color control algorithm to determine the first and second linear regulator control signals. In a further related embodiment, the control module may further include a wireless transceiver to wirelessly receive the CCT signal and the dimmer signal. In a further related embodiment, the control module may further include a multifunctional port, wherein the wireless transceiver may be operatively coupled to the microcontroller via the multifunctional port, and the control module may be configured to be coupled to a programming interface via the multifunctional port to receive the solid state light source parameters.

In another embodiment, there is provided a method of providing color-tunable white light. The method includes: receiving, at a processor, a correlated color temperature (CCT) signal that is proportional to a desired CCT of light emitted by each of a plurality of solid state light source arrays, wherein each of the solid state light source arrays in the plurality of solid state light source arrays includes a first solid state light source module and a second solid state light source module; and determining, with the processor, a first drive current to drive each first solid state light source module in the plurality of solid state light source arrays to emit light having a first CCT and a second drive current to drive the each second solid state light source module in the plurality of solid state light source arrays to emit light having a second CCT, wherein the second CCT is different than the first CCT, and wherein the combination of the light emitted by the first solid state light source modules and the second solid state light source modules results in a mixed light output having a CCT that is substantially the same as the desired CCT.

In a related embodiment, the method may further include: generating the first drive current and the second drive current with a control module; and driving each of the plurality of solid state light source arrays with the control module.

In another related embodiment, the method may further include programming the processor with parameters associated with the first solid state light source modules and the second solid state light source modules during installation of the plurality of solid state light source arrays. In still another related embodiment, the method may further include: receiving, at the processor, a dimmer signal that is proportional to a desired luminous intensity of light emitted by each of the plurality of solid state light source arrays; and determining, with the processor, the first drive current and the second drive current to generate the light emitted by the first solid state light source modules and the second solid state light source modules that results in a mixed light output having a CCT and luminous intensity that is substantially the same as the desired CCT and luminous intensity.

In yet another related embodiment, the method may further include controlling the solid state light source arrays to emit a color temperature-tunable white light over a CCT range that extends between the first CCT and the second CCT. In still yet another related embodiment, the CCT signal may be received via a wireless communication from a user interface configured to control the CCT of light emitted by the plurality of solid state light source arrays.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
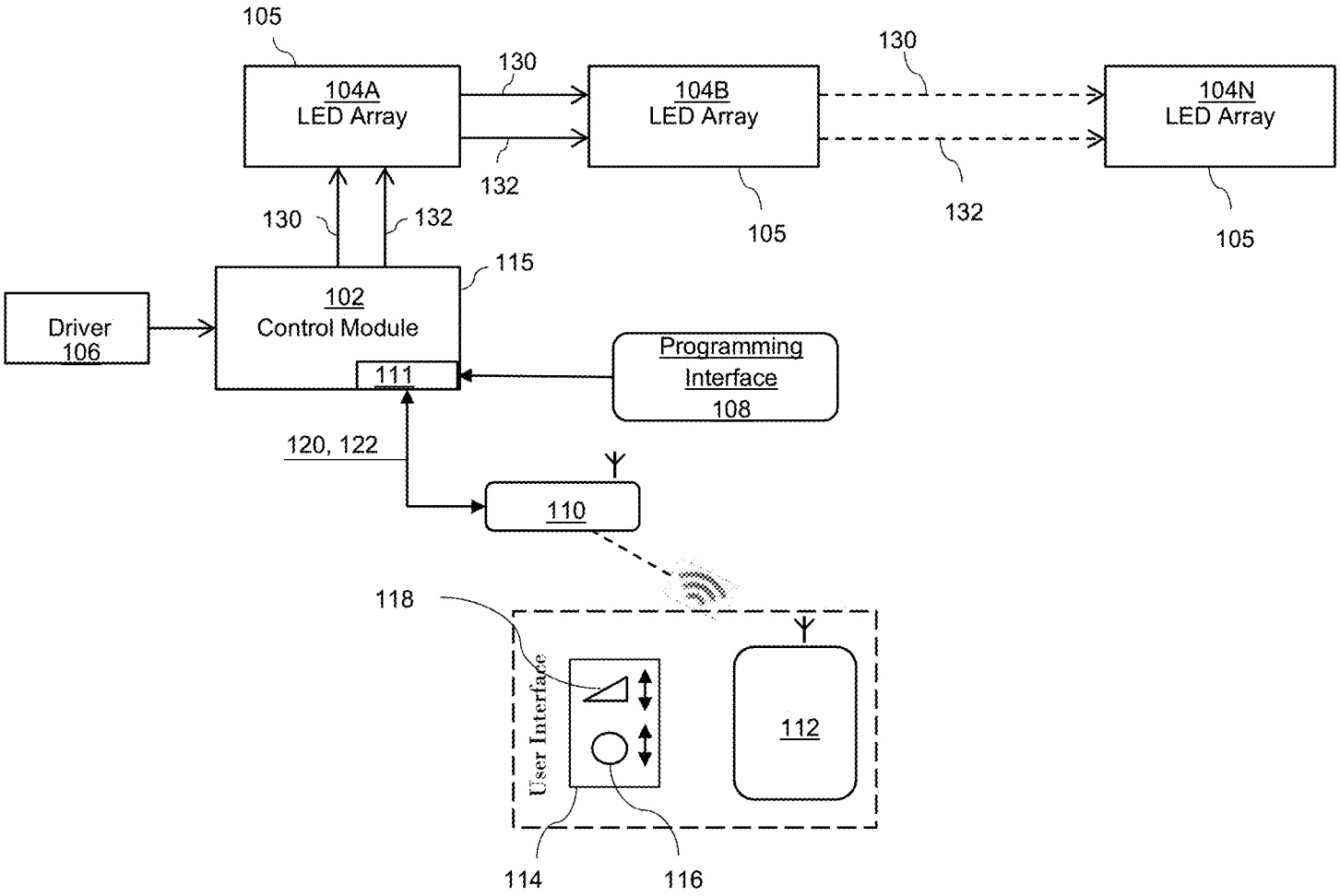
FIG. 1 shows a functional block diagram of a lighting system 100 configured for wireless communication with a user interface and configured to provide a color temperature and intensity tunable light output according to embodiments disclosed herein.

FIG. 1 illustrates a lighting system 100 configured to provide a color temperature and intensity tunable light output. The lighting system 100 includes a control module 102 that is connected to a plurality of solid state light source the plurality of solid state light source arrays 104A, 104B, . . . 104N to control the light emitted by the solid state light source arrays. In FIG. 1, each of the solid state light source the plurality of solid state light source arrays 104 includes a plurality of solid state light sources disposed in a housing 105, and the arrays can be installed throughout a space, such as on a ceiling of one or more rooms of a building, within a structure, etc. The plurality of solid state light source the plurality of solid state light source arrays 104 are electrically connected in series with wired connections that provide currents 130, 132 from the control module 102 to each of the solid state light sources the plurality of solid state light source arrays 104 to drive the solid state light sources in each array. In other embodiments, the plurality of solid state light source the plurality of solid state light source arrays 104 are electrically connected in parallel, in which case output currents from the control module 102 are split evenly between the plurality of solid state light source the plurality of solid state light source arrays 104. The lighting system 100 also includes a driver 106 to provide power to the control module 102. In some embodiments, the driver 106 receives mains power, e.g., 120-277 VAC and provides a DC voltage output, e.g., 48 VDC. The lighting system 100 also includes a programming interface 108, which, as described more below, can be used to program the control module 102 for use with the plurality of solid state light source the plurality of solid state light source arrays 104. The lighting system 100 is configured for wireless communication and includes a wireless transceiver 110 that wirelessly communicates with a user interface 114 and an associated wireless controller 112 to transmit signals to the control module 102. In FIG. 1, the wireless transceiver 110 and the associated wireless controller 112 are configured to communicate over a ZigBee wireless communication protocol. In other embodiments, any of a variety of other wireless network protocols may be used, such as but not limited to Digital Address Line Interface (DALI), Dynet, Starsense, Thread, and so on. In some embodiments, the control module 102 includes a multifunctional port 111 that provides a control and programming interface. As shown in FIG. 1, the multifunctional port 111 provides an interface for the programming interface 108 as well as the wireless transceiver 110, which helps minimize the number of additional components, and results in a fully integrated system. In some embodiments, the control module 102 includes a housing 115 having at least one electrical knockout (not illustrated) and the wireless transceiver 110 is an integrated module removeably disposed in the electrical knockout and operably connected to the control module 102 via, e.g., the multifunctional port 111.

In FIG. 1, the color temperature of light emitted by the plurality of solid state light source the plurality of solid state light source arrays 104 can be described in terms of a correlated color temperature (CCT) in units of, e.g., kelvin (K), as is known in the art. The user interface 114 includes a CCT control 116 to specify the CCT of light emitted by the plurality of solid state light source arrays 104, and a dimmer 118 to specify a luminous intensity of light emitted by the plurality of solid state light source arrays 104. The user interface 114 can provide a CCT signal 120 and a dimmer signal 122 to the control module 102, based on the setting of the CCT control 116 and the dimmer 118. In some embodiments, the user interface 114 is implemented in any of a variety of ways, such as but not limited to a graphical user interface of a mobile application executed on a mobile device and/or a controller located in a fixed indoor device. In some embodiments, the user interface 114 is part of a light management system, an energy management system, a building automation system, or the like. The user interface 114 has a simplified design for providing simple and independent control of CCT and luminous intensity. In other embodiments, the user interface 114 includes customized preset buttons that send a combination of dimmer and CCT commands to the control module 102.

Figure 2:
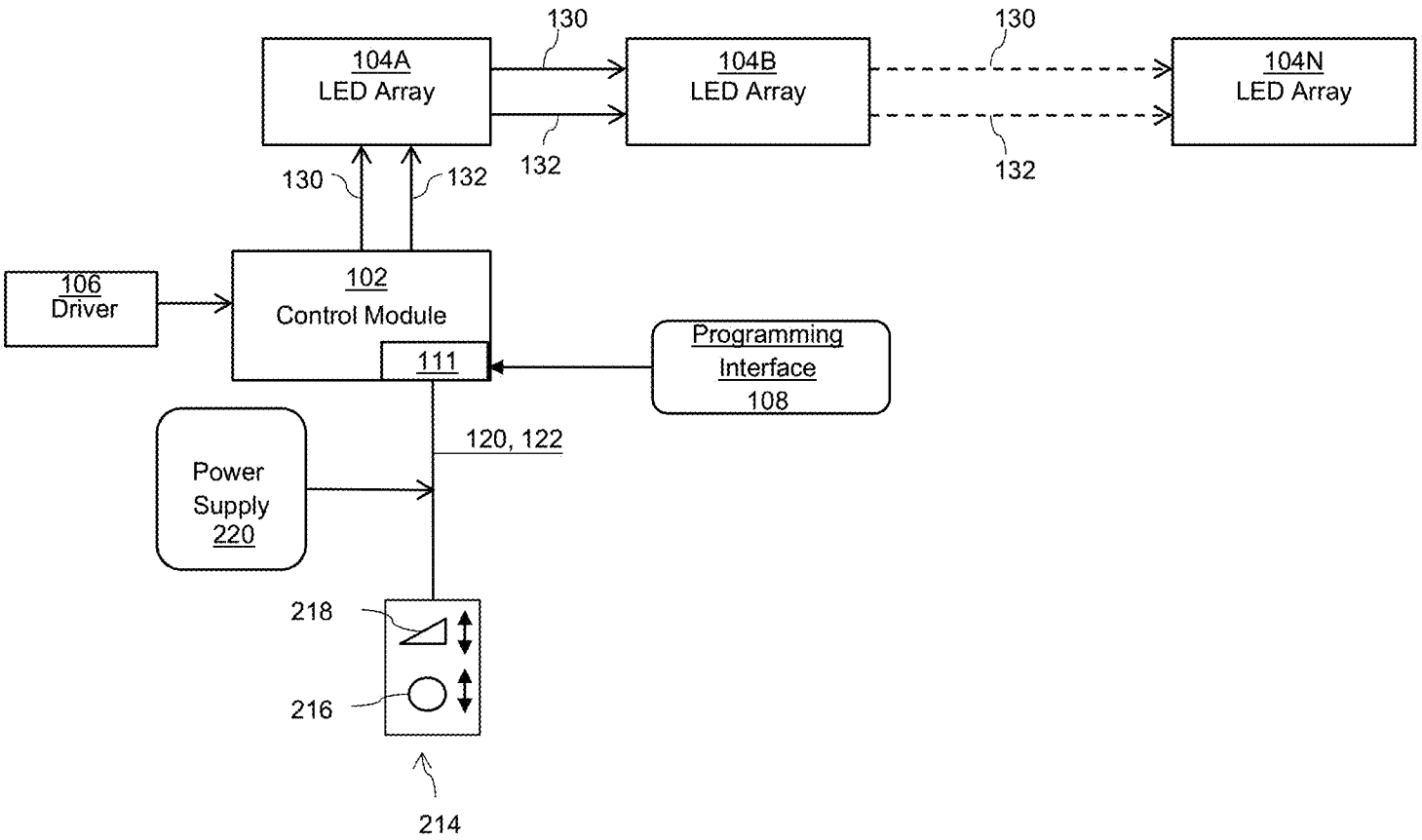
FIG. 2 shows a functional block diagram of a lighting system 200 configured for wired communication with a user interface according to embodiments disclosed herein.

FIG. 2 illustrates a lighting system 200 that is substantially the same as the lighting system 100 of FIG. 1. Unlike the lighting system 100, the lighting system 200 is configured for wired rather than wireless communication with a user interface 214, which similarly includes a CCT control 216 and a dimmer 218. The lighting system 200 also includes a power supply 220 to power the user interface 214.

Figure 3:
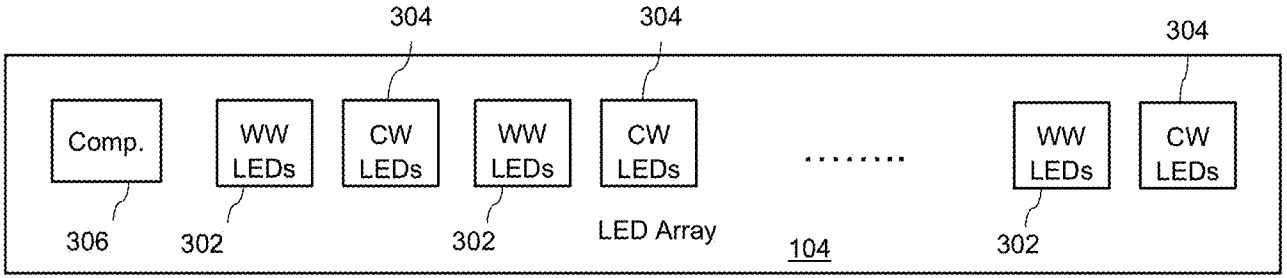
FIG. 3 shows a functional block diagram of an array of solid state light sources, according to embodiments disclosed herein.

FIG. 3 shows one of the solid state light source arrays in the plurality of solid state light source arrays 104 of FIG. 1, which includes a plurality of warm white (WW) modules 302 and a plurality of cool white (CW) modules 304, also referred to herein as warm and cool modules 302, 304, and/or first and second solid state light source modules 302, 304. As noted above, the lighting systems 100 and 200 are configured to provide a CCT and intensity tunable light output. In FIG. 3, CCT adjustability is achieved via two types of modules, e.g., the first solid state light source module 302 and the second solid state light source module 304, that each emit a light having a substantially constant CCT, where each constant CCT is located at one of two extents of a desired range of CCT adjustability in a color space. In some embodiments, the WW modules 302 are configured to emit white light with a substantially uniform first CCT, where the first CCT is the warmest CCT that the lighting system 100/200 is configured to emit. Similarly, the CW modules 304 are configured to emit white light with a substantially uniform second CCT, where the second CCT is the coolest CCT that the lighting system 100/200 is configured to emit. As is known in the art, a "warm" CCT generally refers to relatively lower CCT temperatures and a "cool" CCT generally refers to relatively higher CCT temperatures. Thus, in some embodiments, the first CCT may be a lower temperature in units of, e.g., kelvin than the second CCT. In some embodiments, the first CCT may be in the range of, e.g., 1800K-3000K, 2000K-3000K, 2000K-3500K, or 1800K-2700K, etc. In some embodiments, the second CCT may be in the range of, e.g., 3500K-6500K, 4000K-6500K, or 3000K-5000K, etc.

Figure 4:
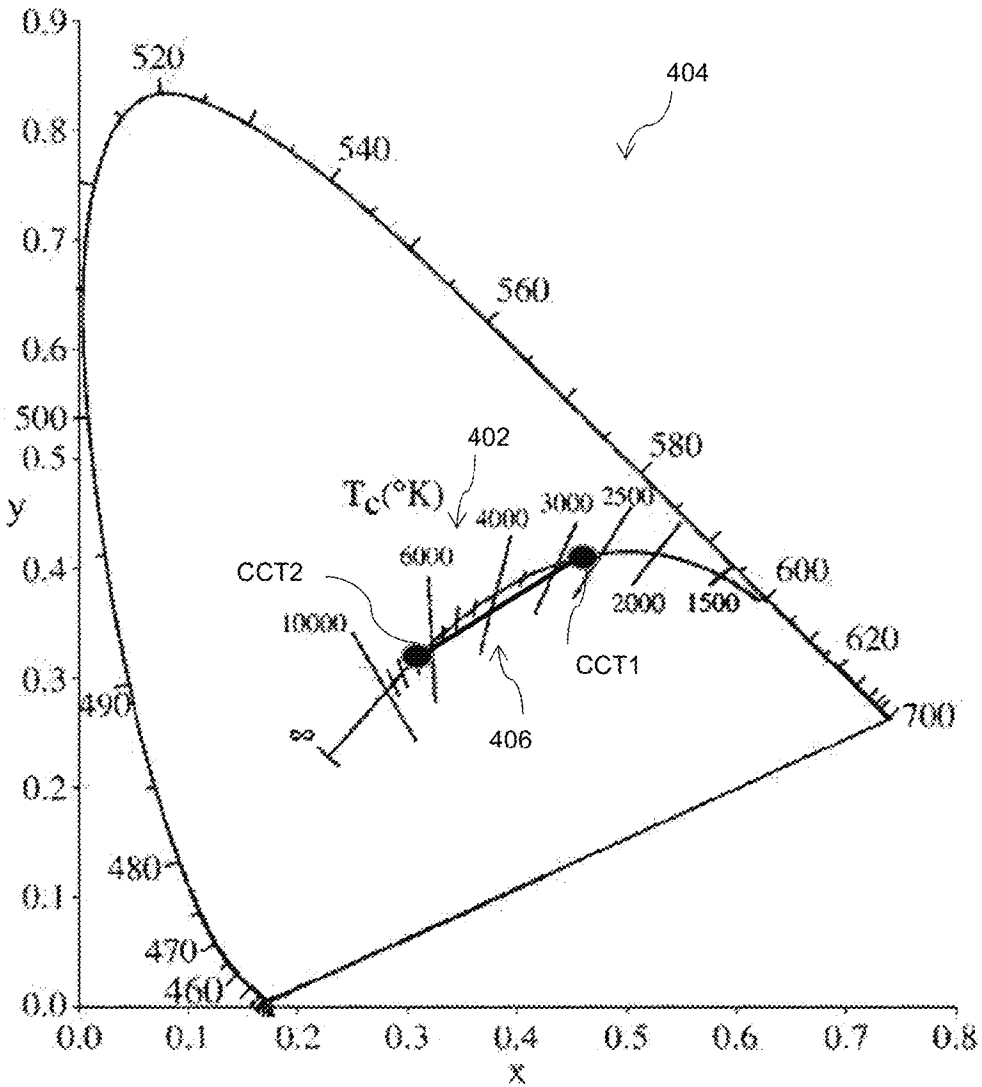
FIG. 4 is a chromaticity diagram showing a black body radiator locus on the CIE 1931 Color Space.

The control module 102 can be configured to adjust a relative output of the WW and CW modules 302, 304 to emit a combined light output having a CCT substantially anywhere between the first CCT and the second CCT. FIG. 4 is a diagram depicting a black body radiator locus 402 on the CIE 1931 Color Space Chromaticity diagram 404, with the numbered points along the radiator locus in units of degree kelvin. FIG. 4 also shows a warm module 302 having a first CCT of approximately 2700 K and a cool LED module 304 having a second CCT of approximately 6500 K. As noted above, in other embodiments, any of a variety of other warm and cool module temperatures may be used and more than two different temperatures may be used. In some embodiments, the combined color temperature emitted by each solid state light source module in the plurality of solid state light source arrays 104 may be controlled approximately along a line 406 between extreme color point temperatures CCT1 (corresponding to the first CCT) and CCT2 (corresponding to the second CCT). As noted above, luminous intensity can be controlled independently of color temperature, such that intensity can be varied at any point along the line 406.

The WW and CW modules 302, 304, may be constructed in any of a variety of ways known in the art for providing one or more color temperatures. For example, each of WW and CW modules 302, 304 may include one or more solid state light sources and one or more phosphor materials to provide white light with a given target CCT. For example, each of the WW and CW modules 302, 304 may include blue LED diodes, and the WW modules 302 may include a first phosphor so as to emit a light having a first target CCT and the CW modules 304 may include a second phosphor so as to emit a light having a second target CCT. One or more of the plurality of solid state light source arrays 104 may also include optics (not illustrated) operably connected to WW and CW modules 302, 304, which can vary, as is known in the art, depending on the particular lighting application the solid state light source array is designed for. In other embodiments, any of a variety of other techniques to provide a light with a given CCT may be used, such as use of adjustable phosphor materials that may be adjusted to change the CCT of light output. As will be appreciated, the plurality of solid state light source arrays 104 can have any number of first and second modules 302, 304, and the first and second modules 302, 304 can be in any geometric arrangement, such as a 1×1, 2×1, or 2×2 array, etc. The plurality of solid state light source arrays 104 may each (or all) also include additional components 306, which may include, by way of example, connectors, reverse polarity protection diodes, and the like. Thus, in some embodiments, each or all of the plurality of solid state light source arrays 104 include CW, WW modules 302, 304 that emit light with a relatively constant CCT, and the individual modules on each solid state light source array in the plurality of solid state light source arrays 104 include only two CCT outputs, the first CCT and the second CCT, that can be combined to emit a combined light having a CCT anywhere between the first CCT and the second CCT. In other embodiments, one or more solid state light source arrays in the plurality of solid state light source arrays 104 include more than two different types of modules that each emit one of more than two different CCTs, such as between 3 and 10 different modules each emitting a light with a different CCT. In other embodiments, one or more solid state light source arrays in the plurality of solid state light sources 104 may include modules that can emit light with more than one CCT.

Referring again to FIG. 1, in some embodiments, both the CCT signal 120 and the dimmer signal 122 are pulse width modulated (PWM) signals with a, e.g., 1 kHz frequency, where a duty ratio of each PWM signal can indicate the CCT or dim setting. For example, a duty ratio of the CCT signal 120 can be directly proportional to a CCT range, e.g., 0-100%=>the first CCT to the second CCT, and a duty ratio of the dimmer signal can be directly proportional to luminous intensity, e.g., 0-100%=>Min_Dim to 100% lumen intensity, where Min_Dim is a low end of the dimming range. In some embodiments, Min_Dim may be set at a value above zero to address noise in the dimmer signal 122.

For example, the CCT and dimmer signals 120, 122 provided by the wireless transceiver 110 may be analog and the signal received by the control module may contain noise at lower levels. In some embodiments, Min_Dim may be in the range of approximately 2-10% of the total dimming range, and in some embodiments, approximately 5-10%, and in some embodiments, approximately 7%. The control module 102 may also be programmed to incorporate a hysteresis to mitigate the impact of noise in the CCT and dimmer signals 120, 122.

Figure 5:
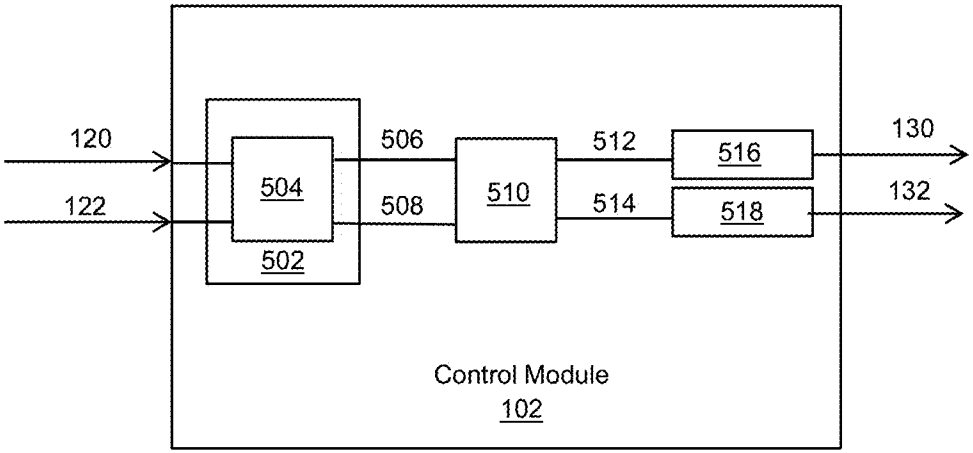
FIG. 5 is a functional block diagram of a control module according to embodiments disclosed herein.

FIG. 5 illustrates a configuration of the control module 102, which may include at least one processor 502 configured to receive the CCT signal 120 and the dimmer signal 122 and apply a color control algorithm 504 to determine currents 130, 132 to drive solid state light sources in the plurality of solid state light source arrays 104. In FIG. 5, the control module 102 is configured to output a warm module current 130 to drive each of the WW modules 302 on each solid state light source array in the plurality of solid state light source arrays 104 and a cool module current 132 to drive each of the CW modules 304. As shown in FIG. 1, each solid state light source array in the plurality of solid state light source arrays 104 are operably connected in series such that the warm and cool module currents 130, 132 are provided to each of the solid state light source arrays in the plurality of solid state light source arrays 104. In some embodiments, the processor 502 can include firmware programmed to read the CCT and dimmer signals 120, 122 via an analog to digital conversion and process the signals with the color control algorithm 504 to output two PWM signals 506, 508, where a pulse width of each of the PWM signals 506, 508 is proportional to the warm and cool module currents 130, 132. The control module 102 can also include an RC network 510 to filter the PWM signals 506, 508 and outputting analog control signals 512, 514 to linear regulators 516, 518 configured to provide constant current warm and cool module currents 130, 132. In some embodiments, the linear regulators 516, 518 may be closed loop current controllers that modulate the currents 130, 132 according to the reference signals 512, 514 received from the DAC network of the processor 502 and the RC network 510.

In FIGS. 1 and 2, the control module 102 can include all necessary components to receive the CCT and dimmer signals 120, 122 and generate the constant current outputs 130, 132 to drive the modules 302, 304 on each solid state light source array in the plurality of solid state light source arrays 104, which, therefore, do not require electrical components to receive and process control signals and instead only require operatively connected modules 302, 304. The plurality of solid state light source arrays 104, for example, do not require any intelligence, processors, or microcontrollers. Such a system architecture provides a variety of benefits, including scalability, where any number of solid state light source arrays can be added to the lighting systems 100 or 200. This also provides for simplicity of design of the plurality of solid state light source arrays 104, where major electrical components, such as a wireless transceiver and processors can be located within the control module 102 rather than on one or more of the solid state light source arrays in the plurality of solid state light source arrays 104, which can reduce the cost of the lighting systems 100, 200. Such an approach can also enable a narrower form factor for the design of the plurality of solid state light source arrays 104 due to fewer required components. This also provides for flexibility of use, where the control module 102 can be calibrated after manufacture for use with any of a variety of different solid state light sources in the plurality of solid state light source arrays 104. For example, the control module 102 can be calibrated with, e.g., the programming interface 108 at the point of use where specific parameters associated with the modules 302, 304 can be downloaded to the control module 102 for application as one or more input parameters to the color control algorithm 504. Example parameters may include color coordinates and lumen-to-current characteristics of the LED modules 302, 304. The control module 102 can also be calibrated at the point of production rather than or in addition to during system installation and/or system modification with module-specific parameters.

Figure 6:
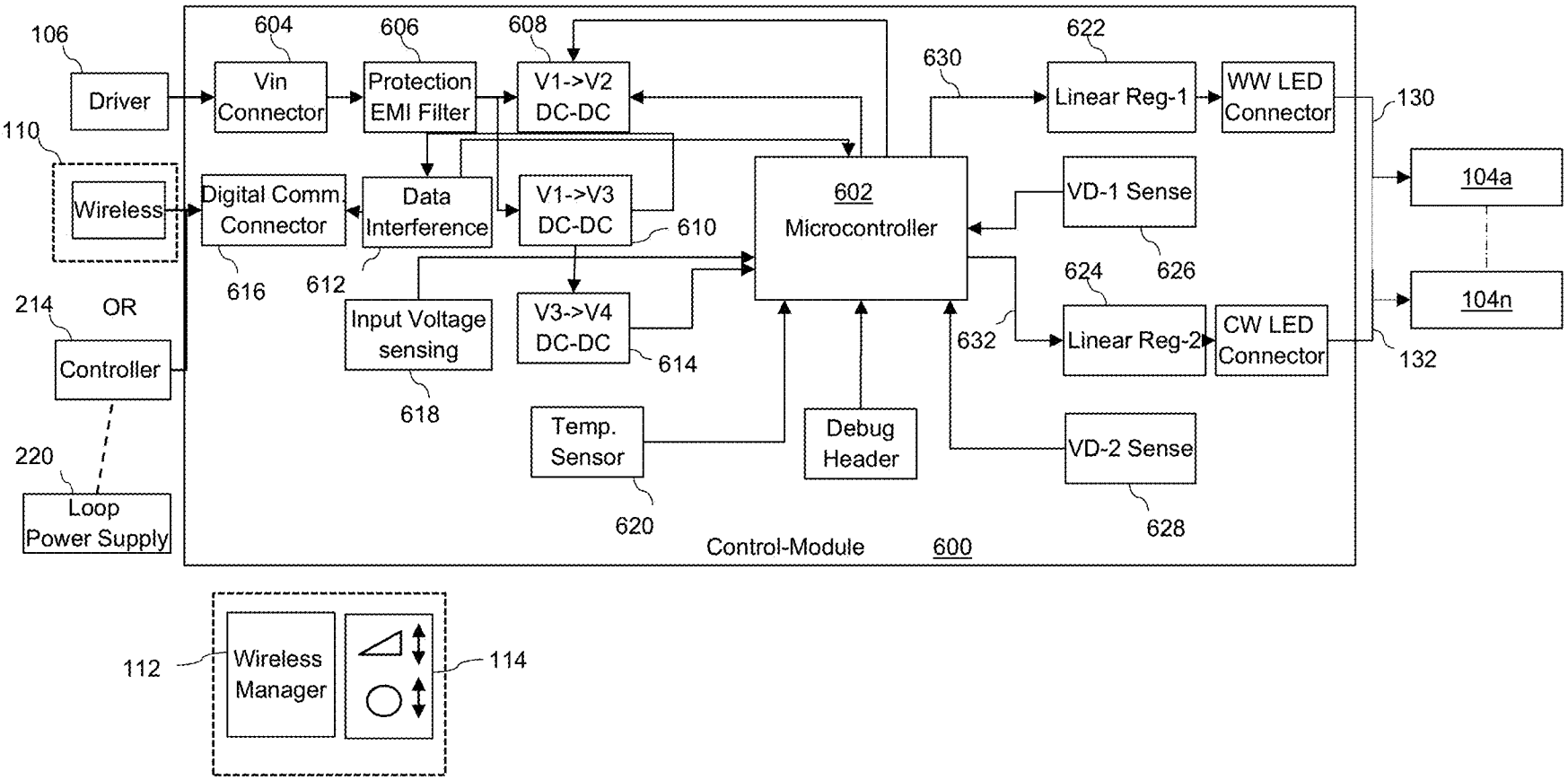
FIG. 6 is a functional block diagram of another control module according to embodiments disclosed herein.

FIG. 6 illustrates another embodiment of the control module 102, referred to herein and in FIG. 6 as a control module 600. The control module 600 is configured to perform the functions described above of the control module 102. In such embodiments, the control module 600 can include a microcontroller 602 that may include one or more processors and may also include a non-transitory machine-readable storage medium containing machine-readable instructions, such as firmware, configured to receive commands from the user interface 114, 214 and generate appropriate constant currents 130, 132 for the plurality of solid state light source arrays 104. In FIG. 6, the control module 600 includes a voltage connector 604 to receive a DC voltage from the driver 106, and an electromagnetic interference (EMI) filter 606 to filter EMI generated by electrical components. The control module 600 also includes an intermediate voltage bus controller 608 that varies an output voltage according to a signal received from the microcontroller 602, where the output voltage can be dynamically varied for efficiency improvement. The control module 600 also includes a DC-DC converter 610 to power a data interface 612 and a second DC-DC converter 614 to power the microcontroller 602. In some embodiments, one or more of the intermediate voltage bus controller 608, the DC-DC converters 610, 614 may be replaced with a multichannel DC-DC converter.

The control module 600 also includes a data interface 612 is configured to receive and transmit control signals such as the CCT and dimmer signals 120, 122 received from the wireless transceiver 110, or in the case of wired communication, directly from the user interface 214 via a digital communication connector 616. The data interface 612 can be configured to receive and transmit data according to any of a variety of protocols, such as DALI, DMX, etc. The control module 600 can also include an input voltage sensor 618 to sense an input voltage to the microcontroller 602 from the second DC-DC power supply 614 to detect any over or under voltage condition, and can include a temperature sensor 620 to sense an on board temperature and send an analog signal representing the sensed temperature to the microcontroller. The control module 600 can also include a warm module linear regulator 622 to provide a constant warm module current 130 to drive warm modules 302 and a cool module linear regulator 624 to provide a constant cool module current 132 to drive cool modules 304. The warm module linear regulator 622 is a voltage to current converter and receives a warm module drive current signal 630 from the microcontroller 602 and then drives the warm modules 302 at a corresponding constant current 130. The cool module linear regulator 624 is similarly a voltage to current convertor that receives a cool module drive current signal 632 from the microcontroller 602 and then drives the cool modules 304 at a corresponding constant current 132. In some embodiments, the power conversion in both linear regulators 622, 624 is analog and not a switched mode, to enable very precise and flicker-free control of the currents 130, 132. The control module 600 may also include voltage sensors 626, 628 to sense a drain source voltage of a MOSFET of the linear regulators 622, 624 for efficiency control purposes. In some embodiments, a control module made in accordance with the present disclosure could utilize switched mode controller linear regulators rather than analog, in which case the control module may not include the voltage sensors 626, 628.

The microcontroller 602 may be configured to decode messages received from the data interface 612 and to encode reply messages prior to sending to the data interface and may also be configured to adjust the voltage on to intermediate voltage bus controller 608 for efficiency improvement. The microcontroller 602 may also configured to receive the CCT and dimmer signals 120, 122 (FIG. 1, 2) and execute a color control algorithm to determine the currents 130, 132 to obtain the desired CCT and luminous intensity. In some embodiments, the microcontroller 602 may be microcontroller part number XMC1301 manufactured by Infineon Technologies AG.

Any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 7:
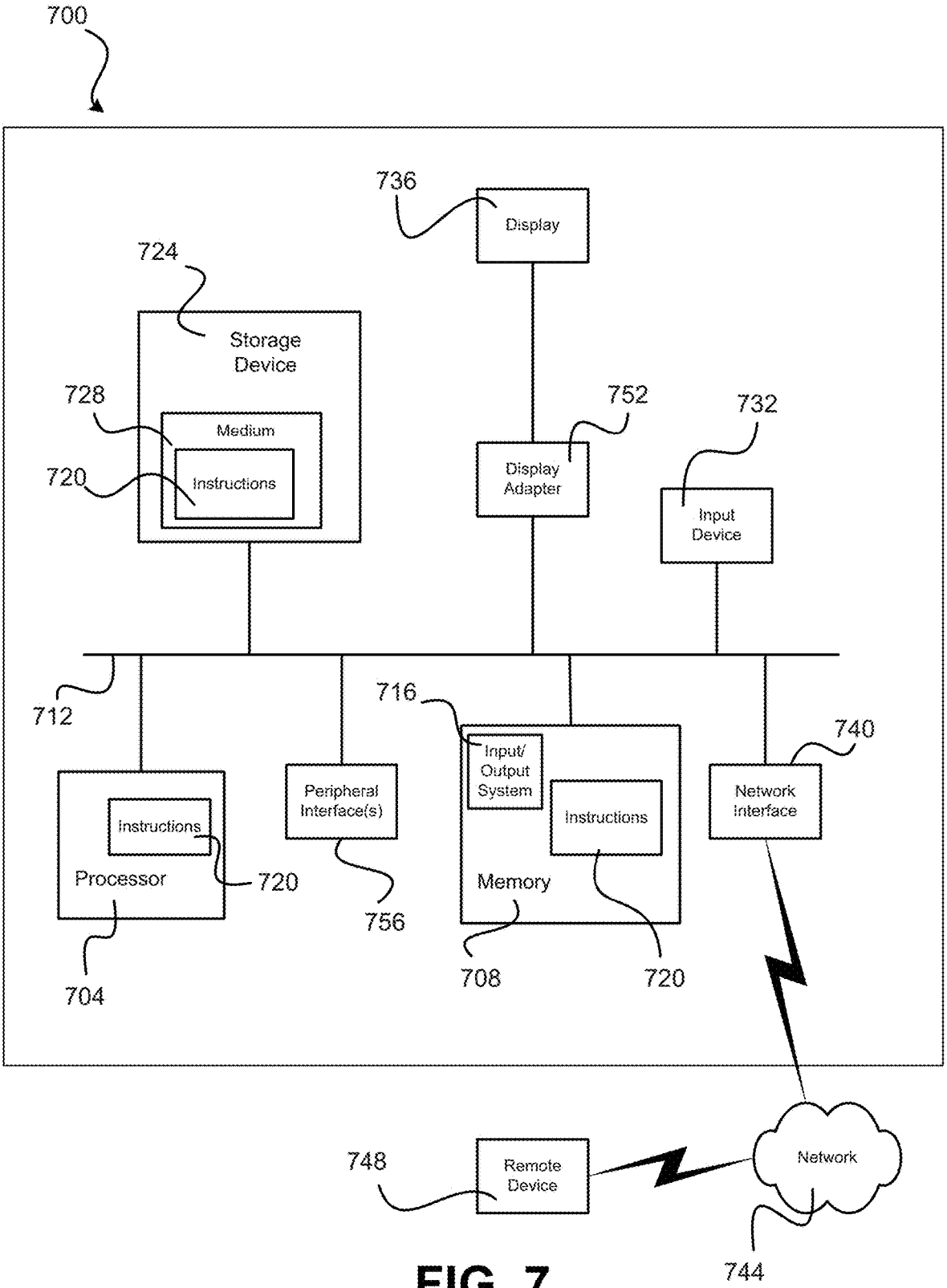
FIG. 7 shows a diagrammatic representation of a computing device according to embodiments disclosed herein.

FIG. 7 shows a diagrammatic representation of a computing device in the exemplary form of a computer system 700 within which a set of instructions cause a system, such as the lighting system 100, 200 of FIGS. 1 and 2, to perform as described herein. It is also contemplated that multiple computing devices may be utilized to implement a specially configured set of instructions for causing one or more of the devices to perform any one or more of the aspects and/or methodologies of the present disclosure. The computer system 700 includes a processor 704 and a memory 708 that communicate with each other, and with other components, via a bus 712. The bus 712 may include any of several types of bus structures including, but not limited to, a memory bus, a memory controller, a peripheral bus, a local bus, and any combinations thereof, using any of a variety of bus architectures.

The memory 708 may include various components (e.g., machine-readable media) including, but not limited to, a random access memory component, a read only component, and any combinations thereof. In one example, a basic input/output system 716 (BIOS), including basic routines that help to transfer information between elements within the computer system 700, such as during start-up, may be stored in the memory 708. The memory 708 may also include (e.g., stored on one or more machine-readable media) instructions (e.g., software) 720 embodying any one or more of the aspects and/or methodologies of the present disclosure. In some embodiments, the memory 708 may further include any number of program modules including, but not limited to, an operating system, one or more application programs, other program modules, program data, and any combinations thereof.

The computer system 700 may also include a storage device 724. Examples of a storage device (e.g., the storage device 724) include, but are not limited to, a hard disk drive, a magnetic disk drive, an optical disc drive in combination with an optical medium, a solid-state memory device, and any combinations thereof. The storage device 724 may be connected to the bus 712 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In some embodiments, the storage device 724 (or one or more components thereof) may be removably interfaced with the computer system 700 (e.g., via an external port connector (not shown)). Particularly, the storage device 724 and an associated machine-readable medium 728 may provide nonvolatile and/or volatile storage of machine-readable instructions, data structures, program modules, and/or other data for the computer system 700. In some embodiments, the software 720 may reside, completely or partially, within the machine-readable medium 728. In some embodiments, the software 720 may reside, completely or partially, within the processor 704.

The computer system 700 may also include an input device 732. In some embodiments, a user of the computer system 700 may enter commands and/or other information into the computer system 700 via the input device 732. Examples of an input device 732 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. The input device 732 may be interfaced to the bus 712 via any of a variety of interfaces (not shown) including, but not limited to, a serial interface, a parallel interface, a game port, a USB interface, a FIREWIRE interface, a direct interface to the bus 712, and any combinations thereof. The input device 732 may include a touch screen interface that may be a part of or separate from a display 736, discussed further below. The input device 732 may be utilized as a user selection device for selecting one or more graphical representations in a graphical interface as described above.

A user may also input commands and/or other information to the computer system 700 via the storage device 724 (e.g., a removable disk drive, a flash drive, etc.) and/or a network interface device 740. A network interface device, such as the network interface device 740, may be utilized for connecting the computer system 700 to one or more of a variety of networks, such as a network 744, and one or more remote devices 748 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as the network 744, may employ a wired and/or a wireless mode of communication. In general, any network topology may be used. Information (e.g., data, the software 720, etc.) may be communicated to and/or from the computer system 700 via the network interface device 740.

The computer system 700 may further include a video display adapter 752 to communicate a displayable image to a display device, such as the display device 736. Examples of a display device include, but are not limited to, a liquid crystal display (LCD), a cathode ray tube (CRT), a plasma display, a light emitting diode (LED) display, and any combinations thereof. The display adapter 752 and the display device 736 may be utilized in combination with the processor 704 to provide graphical representations of aspects of the present disclosure. In addition to a display device, the computer system 700 may include one or more other peripheral output devices including, but not limited to, an audio speaker, a printer, and any combinations thereof. Such peripheral output devices may be connected to the bus 712 via a peripheral interface 756. Examples of a peripheral interface include, but are not limited to, a serial port, a USB connection, a FIREWIRE connection, a parallel connection, and any combinations thereof.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lighting system, comprising:

a plurality of solid state light source arrays configured to emit correlated color temperature (CCT)-tunable light, each of the plurality of solid state light source arrays including a plurality of solid state light source modules;

a user interface configured to provide a CCT signal for setting a CCT of the light emitted by the plurality of solid state light source arrays; and a control module operably connected to the plurality of solid state light source arrays and the user interface, the control module configured to receive the CCT signal, to receive a DC voltage from a driver, and to generate a plurality of drive current signals, wherein each drive current signal controls a linear regulator, and each linear regulator provides a constant current to a respective subset of the solid state light source modules in each of the plurality of solid state light source arrays to cause the plurality of solid state light source arrays to emit light with a CCT according to the CCT signal.

2. The lighting system of claim 1, further comprising a programming interface to program the control module with solid state light source module parameters during installation of the lighting system.

3. The lighting system of claim 1, wherein the user interface is configured to provide a dimmer signal to set a luminous intensity of light emitted by the plurality of solid state light source arrays, wherein the control module is configured to receive the dimmer signal and to provide the constant current to the plurality of solid state light source arrays to cause the plurality of solid state light source arrays to emit light with a CCT and luminous intensity according to the CCT signal and the dimmer signal.

4. The lighting system of claim 1, wherein each of the plurality of solid state light source arrays further comprises a housing, the plurality of solid state light source arrays being located in a spaced relationship within an interior space of a structure, the control module configured to provide the constant current to each of the plurality of solid state light source arrays to drive the solid state light source arrays.

5. The lighting system of claim 1, wherein the plurality of solid state light source modules includes a first solid state light source module configured to emit a white light with a first substantially constant CCT and a second solid state light source module configured to emit a white light with a second substantially constant CCT, wherein the second substantially constant CCT is different than the first substantially constant CCT.

6. The lighting system of claim 5, wherein the lighting system is configured to emit a CCT-tunable white light over a CCT range, wherein the CCT range extends between the first substantially constant CCT and the second substantially constant CCT.

7. The lighting system of claim 6, wherein the control module is configured to control the CCT of light emitted by the plurality of solid state light source arrays over a substantially linear control curve in a chromaticity color space.

8. The lighting system of claim 6, wherein the control module is configured to control the CCT of light emitted by the plurality of solid state light source arrays over a substantially linear control curve that approximates a color temperature emitted by a black body radiator.

9. The lighting system of claim 5, wherein the control module includes a microcontroller configured to apply the CCT signal to a color control algorithm and to determine the drive current signals using the color control algorithm.

10. A control module, comprising:

a microcontroller configured to:

receive a correlated color temperature (CCT) signal, a dimmer signal, and a DC voltage from a driver; and execute a color control algorithm to determine a first linear regulator control signal and a second linear regulator control signal, wherein the first linear regulator control signal and the second linear regulator control signal are each based on the CCT signal and the dimmer signal; and first and second linear regulators configured to:

receive the first linear regulator control signal and the second linear regulator control signal respectively;

generate corresponding respective first and second solid state light source drive currents according to the first and second linear regulator control signals; and provide the first solid state light source drive current to a first subset of a plurality of solid state light source arrays and to provide the second solid state light source drive current to a second subset of the solid state light source arrays.

11. The control module of claim 10, wherein the microcontroller is field programmable to receive solid state light source parameters, and wherein the microcontroller is configured to apply the solid state light source parameters to the color control algorithm to determine the first and second linear regulator control signals.

12. The control module of claim 11, further comprising a wireless transceiver to wirelessly receive the CCT signal and the dimmer signal.

13. The control module of claim 12, further comprising a multifunctional port, wherein the wireless transceiver is operatively coupled to the microcontroller via the multifunctional port, and wherein the control module is configured to be coupled to a programming interface via the multifunctional port to receive the solid state light source parameters.

14. A method of providing color-tunable white light, comprising:

receiving, at a processor, a correlated color temperature (CCT) signal that is proportional to a desired CCT of light emitted by each of a plurality of solid state light source arrays, wherein each of the solid state light source arrays in the plurality of solid state light source arrays includes a first solid state light source module and a second solid state light source module; and determining, with the processor, a first drive current signal to control a first linear regulator which provides constant current to each first solid state light source module in the plurality of solid state light source arrays to emit light having a first CCT and a second drive current signal to control a second linear regulator which provides constant current to each second solid state light source module in the plurality of solid state light source arrays to emit light having a second CCT, wherein the second CCT is different than the first CCT, and wherein the combination of the light emitted by the first solid state light source modules and the second solid state light source modules results in a mixed light output having a CCT that is substantially the same as the desired CCT.

15. The method of claim 14, further comprising:

generating the first drive current and the second drive current with a control module; and driving each of the plurality of solid state light source arrays with the control module.

16. The method of claim 14, further comprising:

programming the processor with parameters associated with the first solid state light source modules and the second solid state light source modules during installation of the plurality of solid state light source arrays.

17. The method of claim 14, further comprising:

receiving, at the processor, a dimmer signal that is proportional to a desired luminous intensity of light emitted by each of the plurality of solid state light source arrays; and determining, with the processor, the first drive current and the second drive current to generate the light emitted by the first solid state light source modules and the second solid state light source modules that results in a mixed light output having a CCT and luminous intensity that is substantially the same as the desired CCT and luminous intensity.

18. The method of claim 14, further comprising:

controlling the solid state light source arrays to emit a color temperature-tunable white light over a CCT range that extends between the first CCT and the second CCT.

19. The method of claim 14, wherein the CCT signal is received via a wireless communication from a user interface configured to control the CCT of light emitted by the plurality of solid state light source arrays.

* * * * *